United States Patent [19]

Riegler et al.

[11] Patent Number: 4,718,645

[45] Date of Patent: Jan. 12, 1988

[54] LADLE STAND ARRANGEMENT FOR TREATING MOLTEN METAL

[75] Inventors: Ernst Riegler, Enns; Ernst Zajicek, Ottensheim, both of Austria

[73] Assignee: Voest-Alpine Aktiengesellschaft, Linz, Austria

[21] Appl. No.: 923,130

[22] Filed: Dec. 24, 1986

[30] Foreign Application Priority Data

Nov. 21, 1985 [AT] Austria ..... 3394/85

[51] Int. Cl.[4] ..... C21C 5/00

[52] U.S. Cl. ..... 266/142; 266/226

[58] Field of Search ..... 266/142, 143, 226, 287

[56] References Cited

U.S. PATENT DOCUMENTS 3,002,739 10/1961 Lawler ..... 266/226
3,149,191 9/1964 McFeaters et al. ..... 266/226
3,412,989 11/1968 Penn ..... 266/226

FOREIGN PATENT DOCUMENTS 2454776 5/1976 Fed. Rep. of Germany .

OTHER PUBLICATIONS

TN, publication of Messo, Duisburg, Germany, Jun. 1979.

*Primary Examiner*—L. Dewayne Rutledge
*Assistant Examiner*—S. Kastler
*Attorney, Agent, or Firm*—Kurt Kelman

[57] ABSTRACT

A ladle stand for treating molten metal includes a vertically liftable and lowerable lance carrying car arranged above a ladle placed in the treatment position. On the car, a reservoir for a treating agent is arranged and adapted to communicate with a cavity of the lance. The lance carrying car is movable to a lance exchange station laterally of the deposited ladle. In order to move the lance carrying car between the deposited ladle and the lance exchange station in a simple manner and with rather low structural expenditures, by ensuring a troublefree lance exchange without manual operations, a stationary vertical rail guide for the lance carrying car is each provided above the ladle placed in the treatment position and above the lance exchange station. A carriage accommodating the lance carrying car is displaceable between the upper ends of the two rail guides. The lance carrying car is equipped with a lance manipulator to hold and release a lance.

2 Claims, 4 Drawing Figures

LADLE STAND ARRANGEMENT FOR TREATING MOLTEN METAL

The invention relates to a ladle stand for treating molten metal, in particular for desulfurizing steel melt, comprising a vertically liftable and lowerable lance carrying car arranged above a ladle placed in the treatment position, on which car a reservoir for a treating agent, in particular a desulfurizing agent, is arranged and adapted to communicate with a cavity of the lance, the lance-carrying car being movable to a lance exchange station laterally of the deposited ladle.

A ladle stand of this type is known from DE-A-24 54 776 and of the pamphlet TN of the company Messo, St 57 d/2000 VI.79. The lance carrying car is displaceable along a vertical guiding column, which is rotatably fastened to the base at a lateral distance from the ladle placed in the treatment position. By turning the guiding column, the largely cantilevering lance carrying car is pivoted from a position above a ladle placed in the treatment position to a lance exchange station for a lance exchange.

Since the lance carrying car, during the treating procedure of the metal melt, is exposed to high vibration loads, the guiding column must be built accordingly firm and, thus, heavy. Due to the great distance of the lance from the guiding column, the guiding column additionally is subjected to a high bending stress, which likewise must be absorbed by an accordingly stable construction of the guiding column and its pivot bearing.

As a result of the large projection of the lance or lance carrying car and the unstable quidance of the lance involved, difficulties may occur with the known structures when transferring or exchanging the lances at the lance exchange station such that an automatic exchange is feasible only under great difficulties.

The invention aims at avoiding these disadvantages and difficulties and has as its object to provide a ladle stand of the initially defined kind, in which the lance carrying car is movable between the deposited ladle and the lance exchange station in a simple manner and with rather low structural expenditures, wherein a trouble-free lance exchange at the lance carrying car without manual operations is ensured.

In accordance with the invention, this object is achieved a by providing respective stationary vertical rail guide for the lance carrying car above the ladle placed in the treatment position and above the lance exchange station a. carriage to receive the lance carrying car is displaceable between the upper ends of the two rail guides, the lance carrying car being equipped with a lance manipulator to hold and release a lance, which is movable from an operating position into a lance exchange position laterally beside the operating position so as to cantilever from the lance carrying car, and back, and a coupling means is arranged above the operating position of the lance manipulator and operable by an actuating unit to provide communication of the reservoir with the cavity of the lance.

Since the lance carrying car needs to cantilever from the rail guides only slightly, the stationary rail guides may be designed to be lightweight, though stable, and sufficiently rigid. Oscillations at the guide rails and, thus, inaccuracies with respect to the guidance of the lance will thereby be prevented. Hence results a high safety during the automatic exchange of a lance by means of the lance manipulator at the lance exchange station so that manual interference by the operating personnel will be avoided.

Preferably, the lance manipulator is formed by a car mounted in the lance carrier in a horizontally displaceable manner and operable by an actuating means, wherein grip pliers are fastened to this car, which are operable by a further actuating means.

The invention will now be explained in more detail by way of an embodiment with reference to the accompanying drawings, wherein.

Figure 1:
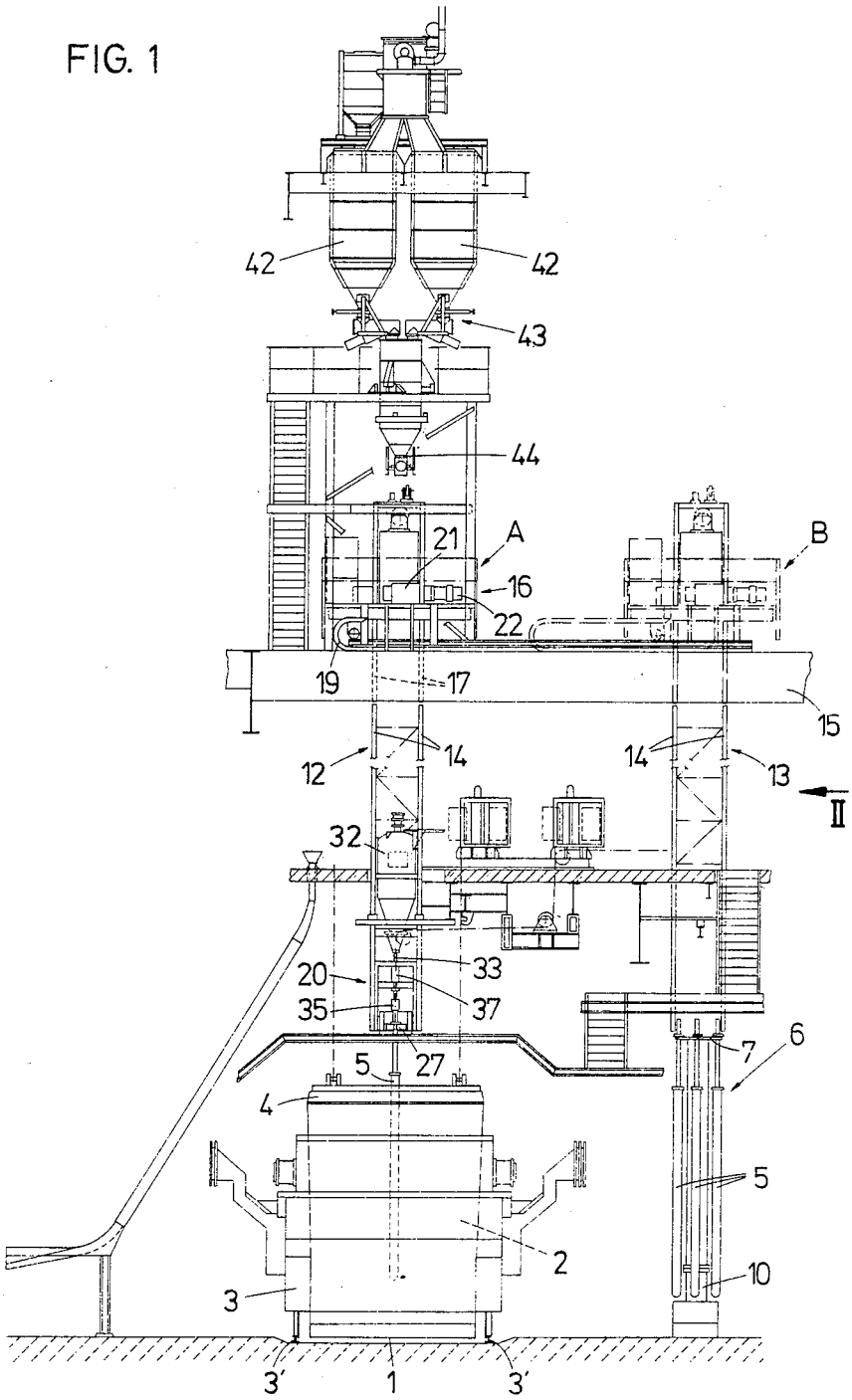
FIG. 1 is a general side view of the ladle stand.
Figure 2:
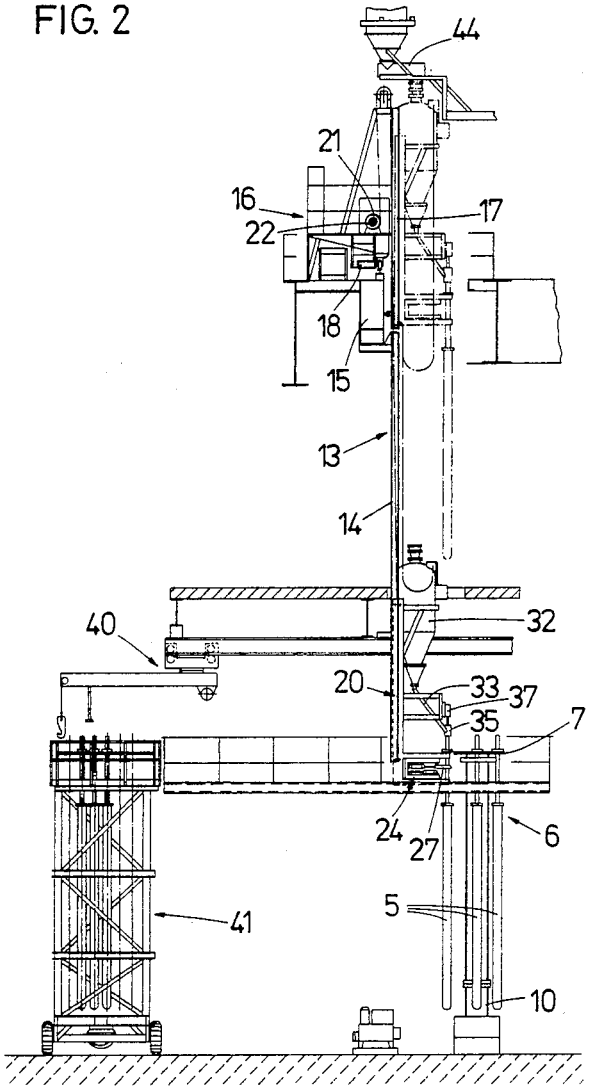
FIG. 2 is a view in the direction of the arrow II of FIG. 1.

On a base, there is provided a deposition site 1 for a ladle 2 in a ladle stand, to which the ladle 2 is movable by means of a ladle car 3 displaceable along rails 3'. The ladle 2 is covered by a lid 4 comprising an opening to introduce a treating lance 5.

Laterally beside the deposition site 1, a lance exchange station 6 is also arranged on the base and is formed by a horizontally arranged rotary disc 7, on the circumference of which lance retaining means 8 are evenly distributed, into which the lances 5 are suspendible by their upper ends 9. The rotary disc 7 is supported on the base by a supporting column 10. The lances, on their upper ends, each comprise a collar 11 by which they hang from the lance retaining means 8.

Both above the ladle deposition site 1 and above the lance exchange station 6, a stationary vertical rail guide 12, 13 is provided at a slight lateral distance, each comprised of two parallel rails 14 reinforced like frameworks. The upper ends of the two rail guides are at the same height closely below a stationary horizontal girder 15. Along the girder 15, a carriage 16 is displaceable from one rail guide to the other and back.

This carriage 16 comprises rails 17 arranged in alignment with the rails 14 of the rail guides 12, 13 and ending closely above the rails 14. It may, therefore, be selectively moved from a first position A, which is illustrated in FIG. 1 in full lines and in which its rails 17 register with the rails 14 of the rail guide 12 arranged above the ladle deposition site 1, into a position B, which is illustrated in FIG. 1 in dot-and-dash lines and in which its rails 17 register with the rails 14 of the rail guide 13 arranged above the lance exchange station 6. The drive motor is denoted by 18, the energy supply is effected via flexible trailing cables 19.

A lance carrying car 20 serves to lift and lower the lances 5 and to make over a lance 5 from the lance exchange station 6, which lance carrying car 20 is displaceable along rail guides 12, 13 in the vertical direction and may be lifted and lowered by means of a rope winch 21 disposed in the carriage 16 and driven by a motor 22.

The carriage 16 is arranged at such a height above the ladle lid 4 that the lance 5 may be lifted completely out of the ladle 2, wherein the lance carrying car 20 is on the rails 17 of the carriage 16 with the lance 5 being in the lifted position, so that it is movable with the carriage 16 from one rail guide 12 to the other rail guide 13 and back.

In order to automatically deliver a lance 5 from the lance carrying car 20 onto the rotary disc 7 and to take over a lance 5 from the rotary disc 7 onto the lance carrying car 20, the lance carrying car 20, on its lower end, comprises a lance manipulator 24 constituted by a car horizontally displaceable by means of a pressure medium cylinder 23 and guided along consoles 26 horizontally cantilevering from the lance carrying car 20, by means of guide rollers 25. To the car 24, grip pliers 27 are fastened, whose jaws 28 are adapted to be opened and closed by a lever linkage 30 by means of a pressure medium cylinder 29.

Figure 3:
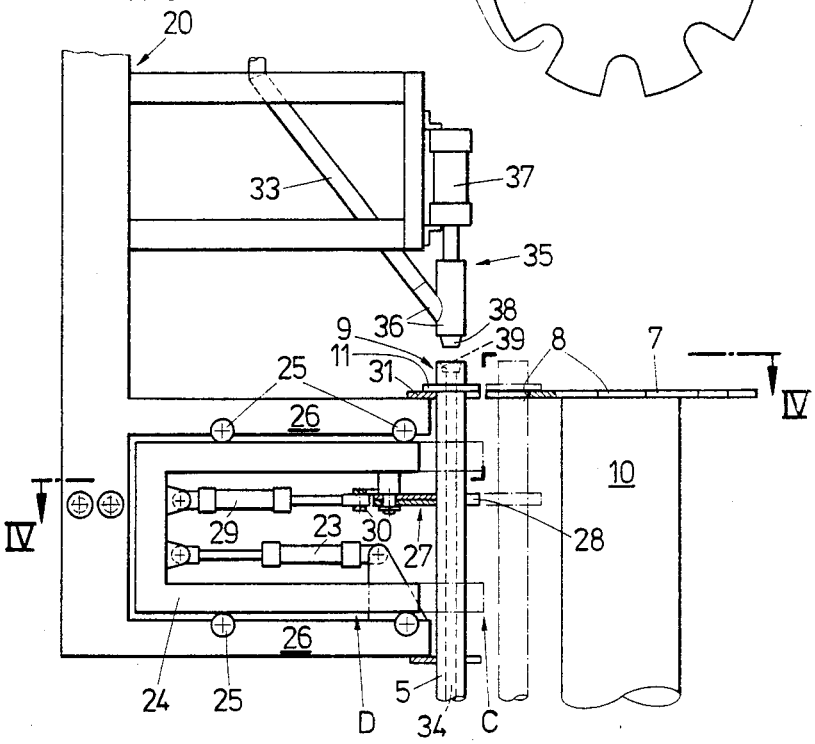
FIG. 3 shows a detail of FIG. 2 on an enlarged scale.

As is apparent from FIG. 3, a lance 5 hanging from the lance carrying car 20 may be pushed onto the rotary disc 7 by means of the jaws 28 by moving the car 24 into the lance exchange position C illustrated in dot-and-dash lines. By moving the car 24 back into the operation position D illustrated in full lines, the lance 5 that has been seized by the grip pliers 27 may be pushed onto a lance retaining means 31 provided on the lance carrying car 20.

To supply treating agent for the molten metal present in the ladle 2, the lances 5 are hollow, the lance carrying car 20 including a reservoir 32 for the treating agent. This reservoir 32 communicates with the cavity 34 of the lance 5 via a duct 33 conveying the treating agent, a coupling means 35 being provided to automatically set this duct 33 in communication with the cavity 34 of the lance. This coupling means 35 is formed by an angular pipe section 36, which is liftable and lowerable by means of a pressure medium cylinder 37. One end of the angular pipe section 36 is in connection with the flexible duct 33. The other end of the angular pipe section comprises a cone 38 to be inserted into a frustoconical orifice 39 on the upper end of the lance 5.

Figure 4:
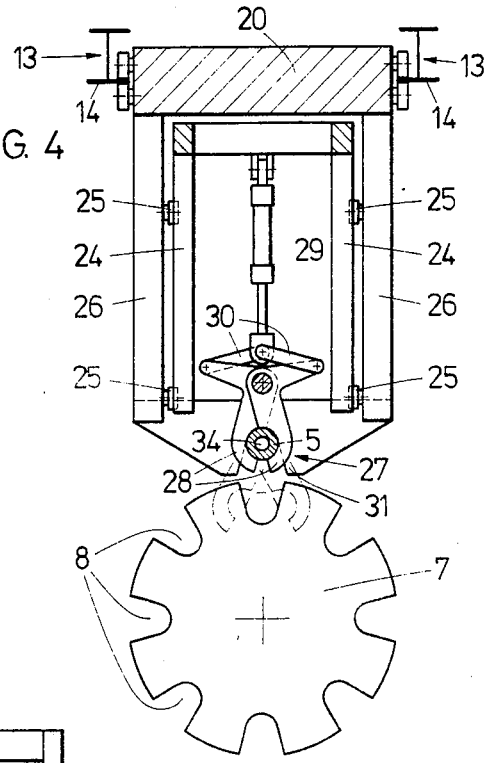
FIG. 4 is a section along line IV–IV of FIG. 3.

The rotary disc at the lance exchange station is rotatable stepwise by a stepping unit such that the lance manipulator 24 of the lance carrying car 20—when position beside the lance exchange station 6 (cf. FIG. 4)—always will be opposite a free lance retaining means 8 to receive a used lance 5, or a lance retaining means 8 comprising a lance 5. The lance exchange station 6 is fed with lances 5 via a hoist 40 displaceable in the horizontal direction and seizing lances from a lance carriage 41.

Tanks 42 arranged above the ladle deposition site 1 serve to fill the reservoir 32 of the lance carrying car 20 with treating agent, which treating agent is drawn by conveying and metering means 43 in special pre-selectable amounts and is supplied to the reservoir 32 by means of a further supply duct 44.

What we claim is:

1. A ladle stand arrangement for treating molten metal, comprising a ladle placed in a treatment position, a vertically liftable and lowerable car carrying a lance and arranged above said ladle, a reservoir for a treating agent on said car, said lance having a cavity arranged to be in communication with said reservoir, and a lance exchange station arranged laterally of said treatment position, said lance carrying car being movable between said treatment position and said lance exchange station, wherein the improvement comprises a respective stationary vertical rail guide means for said lance carrying car arranged in vertical alignment with the treatment position and said lance exchange station, a carriage for said lance carrying car and displaceable between the upper ends of said rail guide means for respective vertical alignment therewith, a lance manipulating means arranged on said lance carrying car and adapted to hold and release a lance, said lance manipulating means being movable between an operating position and a lance exchange position laterally beside said operating position and cantilevering from said lance carrying car, a coupling means arranged on said lance carrying car above the operating position of said lance manipulating means, and an actuating unit arranged on said lance carrying car and adapted to operate said coupling means to provide for communication of said reservoir with said cavity of said lance.

2. A ladle stand arrangement as set forth in claim 1, wherein said lance manipulating means is comprised of a horizontally displaceable car mounted on said lance carrying car, and further comprising first actuating means provided to actuate said horizontally displaceable car, grip pliers fastened to said horizontally displaceable car, and further actuating means for actuating said grip pliers.

* * * * *

UNITED STATES PATENT AND TRADEMARK OFFICE

CERTIFICATE OF CORRECTION

PATENT NO. : 4,718,645

DATED : January 12, 1988

INVENTOR(S) : ERNST RIEGLER ET AL

It is certified that error appears in the above-identified patent and that said Letters Patent are hereby corrected as shown below:

Cover page, column 1, item [75] line 2, after "Ottensheim" delete ", both" and substitute therefor --; Hubert Hammerschmid, Linz, all--;

item [22], delete "Dec. 24, 1986" and substitute therefor --Oct. 24, 1986--.

Column 2, line 53, delete "make" and substitute therefor --take--.

Signed and Sealed this

Thirtieth Day of August, 1988

*Attest:*

*Attesting Officer*

DONALD J. QUIGG

*Commissioner of Patents and Trademarks*